US007467574B1

(12) United States Patent
Lin

(10) Patent No.: US 7,467,574 B1
(45) Date of Patent: Dec. 23, 2008

(54) VERSATILE FOLDING RATCHET TOOL

(76) Inventor: Yuan-Ho Lin, P.O. Box 36-80, Taichung (TW)

( * ) Notice: Subject to any disclaimer, the term of this patent is extended or adjusted under 35 U.S.C. 154(b) by 0 days.

(21) Appl. No.: 11/983,307

(22) Filed: Nov. 8, 2007

(51) Int. Cl.
*B25B 13/06* (2006.01)

(52) U.S. Cl. ..... 81/60; 81/177.85; 81/426.5

(58) Field of Classification Search ..... 81/177.85, 81/60–63.2, 426.5, 427.5, 436–440
See application file for complete search history.

(56) References Cited

U.S. PATENT DOCUMENTS 5,329,834 A * 7/1994 Wong ..... 81/58.3
6,601,481 B2 * 8/2003 Chuang ..... 81/440
6,935,212 B2 * 8/2005 Wadsworth ..... 81/60

* cited by examiner

*Primary Examiner*—Joseph J. Hail, III
*Assistant Examiner*—Anthony Ojini
(74) *Attorney, Agent, or Firm*—Charles E. Baxley

(57) ABSTRACT

A versatile folding ratchet tool comprises a ratchet assembly having two driving ends; and two tool assemblies connected to the two driving ends of the ratchet assembly, respectively; wherein each said tool assembly comprises a rotational core having one side connected to and driven by the driving end of the ratchet assembly; and two tool arms, each having one end thereof pivotably connected to the rotational core so that the tool arm is able to pivot with respect to the rotational core between a parallel position and a perpendicular position; and having an opposite end thereof pivotally attached by at least one tool element capable of pivoting with respect to the tool arm between a folded position and an extended position.

7 Claims, 7 Drawing Sheets

VERSATILE FOLDING RATCHET TOOL

BACKGROUND OF THE INVENTION

1. Technical Field

The present invention relates to hand tools and, more particularly, to a versatile folding ratchet tool.

2. Description of Related Art

Screwdrivers and wrenches are necessary for people who have the needs to work with threaded fasteners. These hand tolls are typically prepared in serials comprising various sizes so as to match threaded fasteners with diverse dimensions and specifications. Further more, for facilitating a user's exerting effort, the traditional hand tools are always equipped with stationary elongate handles that substantively take space and give weight to the handles. Thus, it would be a challenge for a user who tries to pick up the very tool he needs from a crowd of such traditional screwdrivers or wrenches, which is bulky and heavy.

Moreover, ratchet tools are popular among tool users for the facility thereof. In such ratchet tool, a tool blade is locked to a handle for rotation along one direction, and is uncoupled for rotation along the opposite direction so as to be facile in narrow operating space.

Under these circumstances in view, the inventor of the present invention made an attempt on a versatile folding ratchet tool that integrates the functions of traditional, conventional folding and ratchet hand tools and discloses such versatile folding ratchet tool herein.

SUMMARY OF THE INVENTION

It is one objective of the present invention to provide a versatile folding ratchet tool having the advantages of compact size, portability and facility so as to reduce the costs and storage space required by conventional hand tool.

To achieve these and other objectives of the present invention, the versatile folding ratchet tool comprises a ratchet assembly having two driving ends; and two tool assemblies connected to the two driving ends of the ratchet assembly, respectively; wherein each said tool assembly comprises a rotational core having one side connected to and driven by the driving end of the ratchet assembly; and two tool arms, each having one end thereof pivotably connected to the rotational core so that the tool arm is able to pivot with respect to the rotational core between a parallel position and a perpendicular position; and having an opposite end thereof pivotally attached by at least one tool element capable of pivoting with respect to the tool arm between a folded position and an extended position.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Please refer to FIGS. 1 through 9 for one embodiment of the versatile folding ratchet tool of the present invention.

Figure 1:
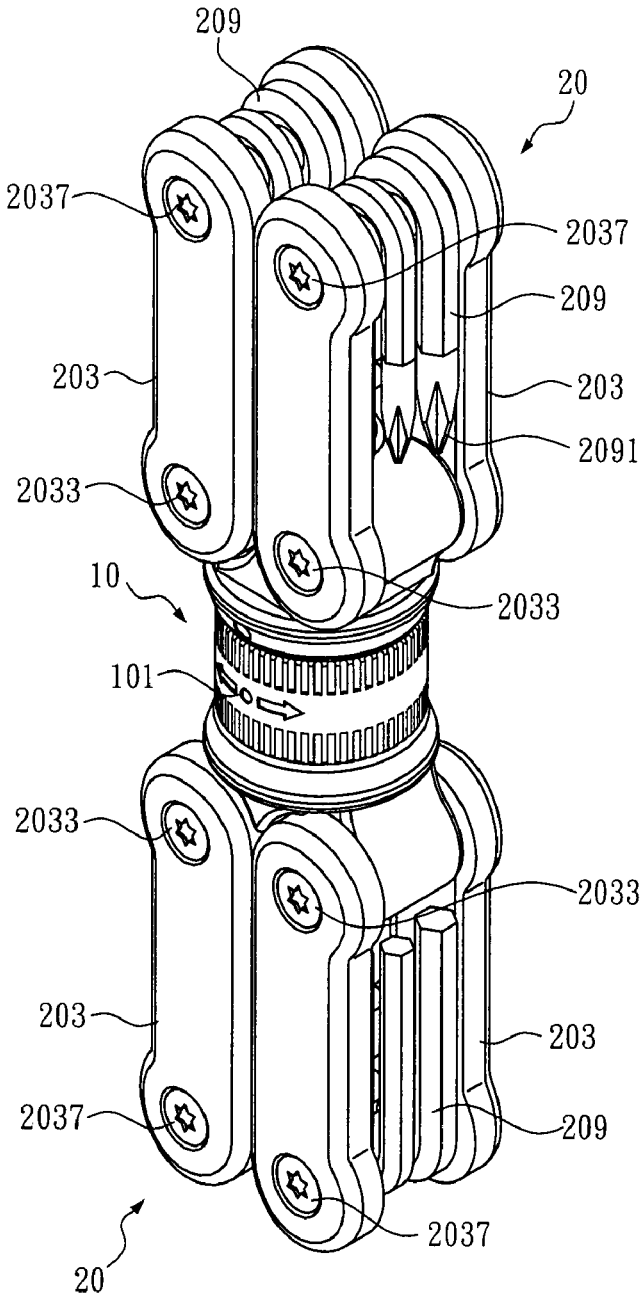
FIG. 1 is a perspective view of a versatile folding ratchet tool according to one embodiment of the present invention.
Figure 2:
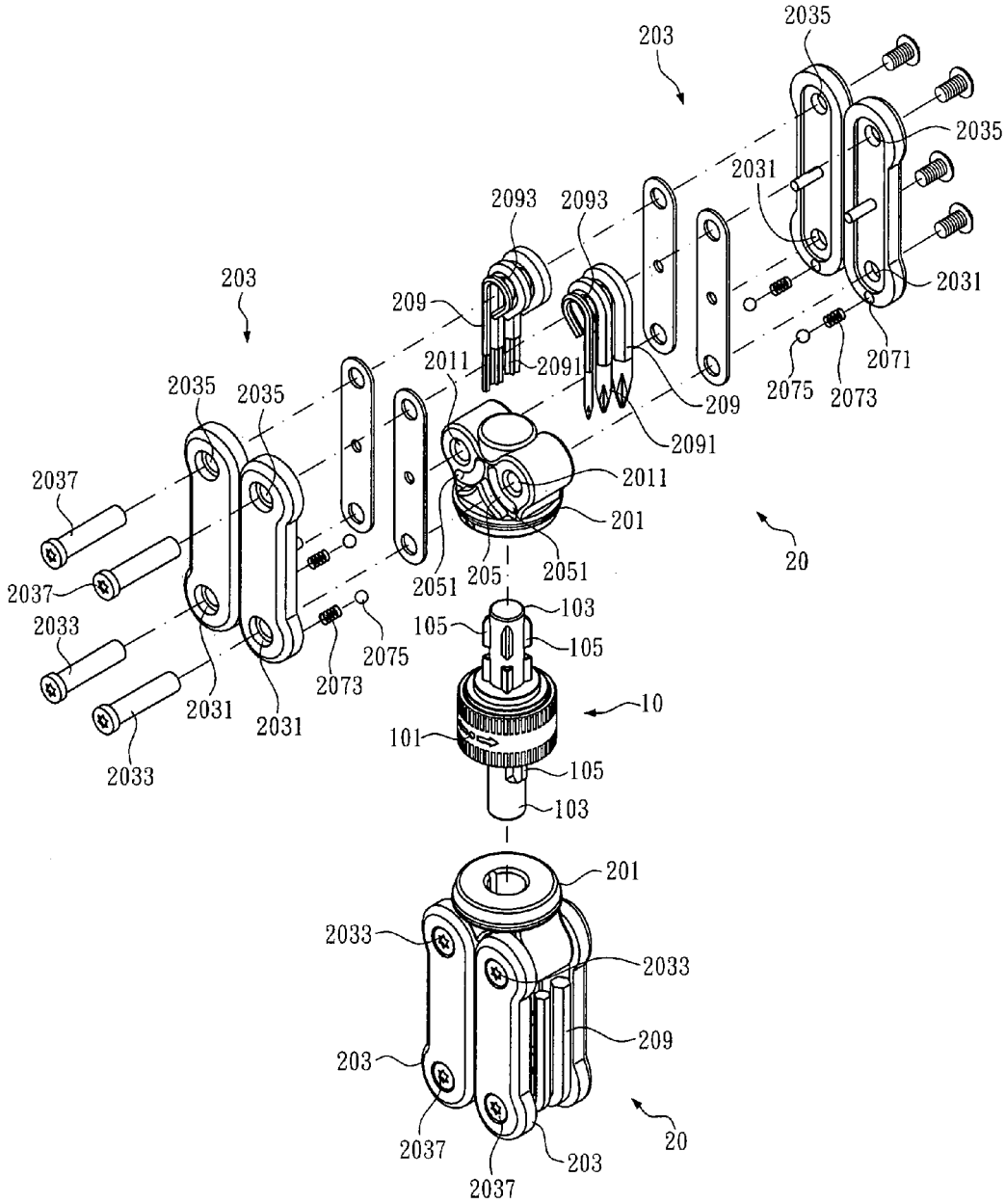
FIG. 2 is an exploded view of the versatile folding ratchet tool according to the embodiment of the present invention.
Figure 3:
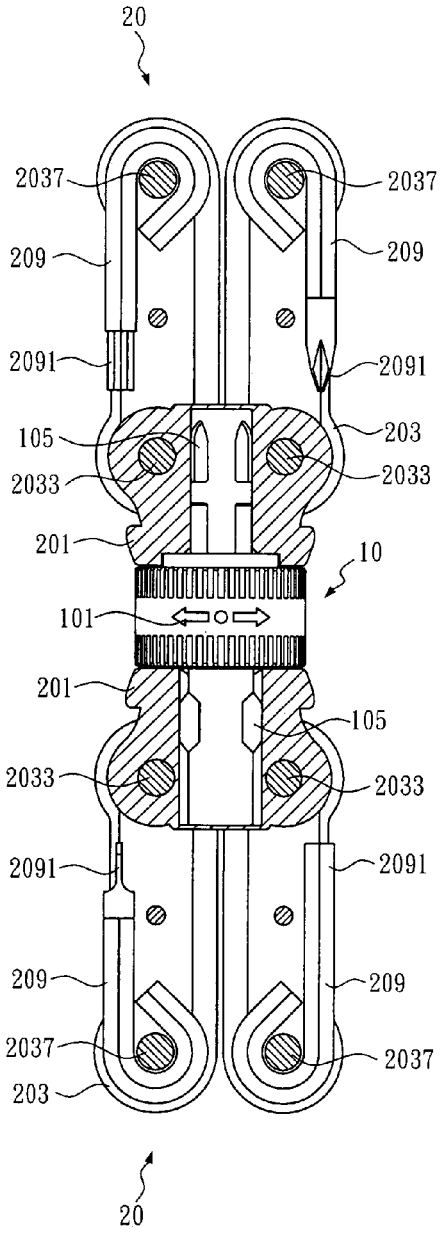
FIG. 3 is a cross sectional view of the versatile folding ratchet tool according to the embodiment of the present invention.
Figure 4:
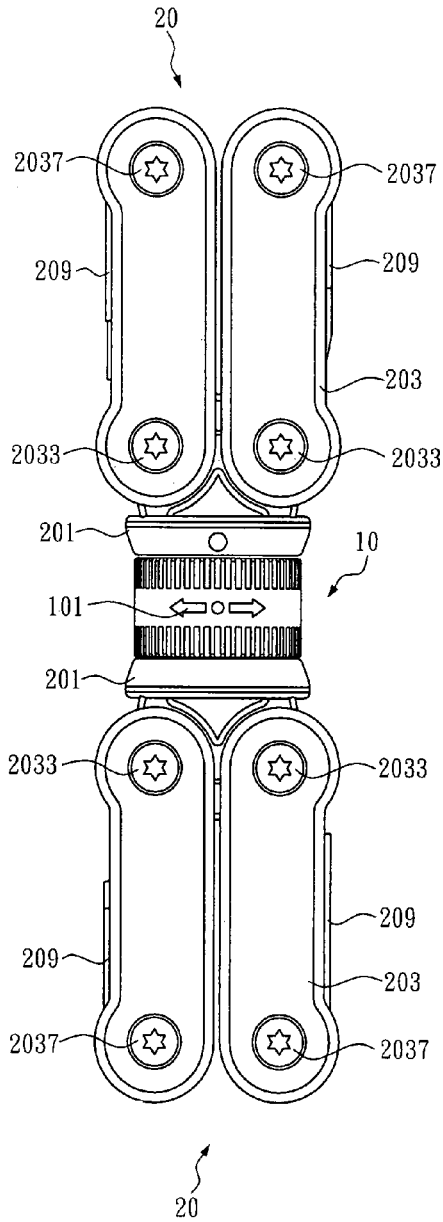
FIG. 4 is a front view of the versatile folding ratchet tool according to the embodiment of the present invention.
Figure 5:
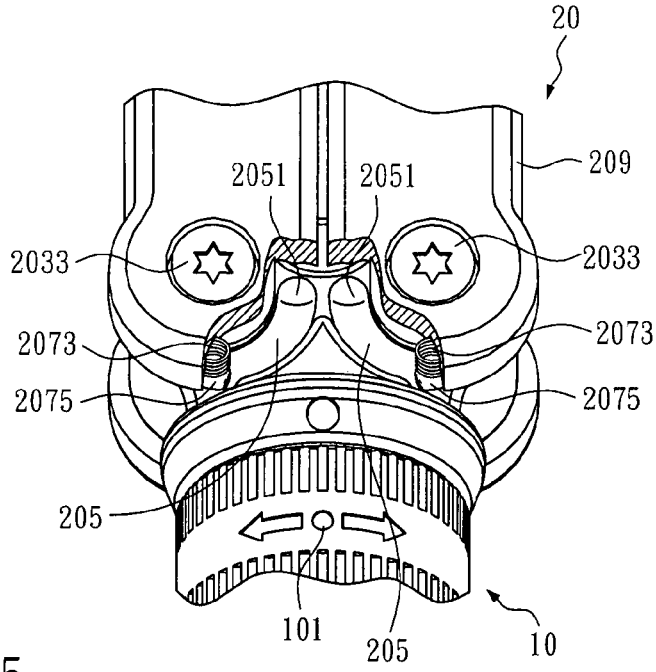
FIG. 5 is an enlarged view of the versatile folding ratchet tool according to the embodiment of the present invention showing the structure of the positioning mechanism.
Figure 6:
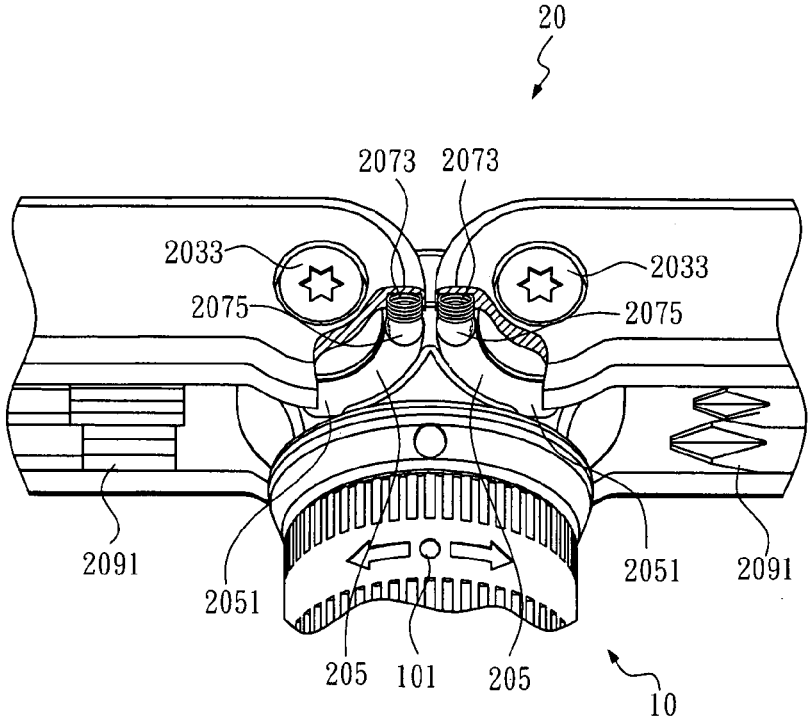
FIG. 6 is another enlarged view of the versatile folding ratchet tool according to the embodiment of the present invention showing the structure of the positioning mechanism.

Referring to FIGS. 1, 2 and 3, a versatile folding ratchet tool of the present invention primarily comprises a ratchet assembly 10 and two tool assemblies 20. Therein, the ratchet assembly 10 may be a conventional ratchet assembly, which is locked from rotating along one direction and free to rotating along an opposite direction. Alternatively, according to the present embodiment, the ratchet assembly 10 is a reversible ratchet assembly. By operating a direction selector 101 thereof, a user can easily change the direction where the ratchet rotates along. As such reversible ratchet assembly 10 is well known by people, additional details concerning the internal construction thereof need not be disclosed in connection with the present invention.

The ratchet assembly 10 has two driving ends 103 and each said driving end 103 is fixedly attached by a rotational core 201 of one said tool assembly 20 so that the two tool assemblies 20 can be driven by the movement of the ratchet assembly 10 and rotate synchronously. As can be seen from FIG. 2, the driving ends 103 of the ratchet assembly 10 is provided with a plurality of protuberances 105, so that in the close-fit combination between the driving ends 103 and the rotational core 201 of the tool assemblies 20, the protuberances 105 contribute to retaining the rotational cores 201 from rotating with respect to the driving ends 103.

In addition to the rotational core 201, each of the tool assemblies 20 further includes two tool arms 203. It can be seen from the drawings that each of the tool arms 203 has one end thereof pivotably connected to the rotational core 201 so that the tool arm 203 is able to pivot with respect to the rotational core 201 between a parallel position as and a perpendicular position. Further, each of the tool arms 203 has an opposite end thereof pivotally attached by at least one tool element 209 capable of pivoting with respect to the tool arm 203 between a folded position and an extended position.

According to the present embodiment, each of the rotational cores 201 has two pivot holes 2011 and the tool arms 203 have the ends connected to the rotational core 201 also provided with inner pivot holes 2031 so that when two inner pivots 2033 are passed through the pivot holes 2011 and inner pivot holes 2031 of the rotational core 201 and tool arms 203, the two tool arms 203 are connected to the rotational core 201 in a pivotable way.

Further, the disclosed versatile folding ratchet tool may have a positioning mechanism provided between the rotational core 201 and each said tool arm 203 for positioning the tool arms 203 at either the parallel position or the perpendicular position. Please see FIGS. 2, 5 and 6. In the present embodiment, the positioning mechanism comprises a guiding slot 205 preformed below each of the pivot holes 2011 of the rotational core 201. Particularly, each of the guiding slots 205 on the rotational core 201 may be formed with two seats 2051 at two ends thereof wherein the seats have an identical depth greater than that of the rest part of the guiding slot. On the other hand, each said tool arm 203 has an elastic positioning piece provided below the inner pivot hole 2031 thereof. The elastic positioning piece of the tool arm 203 is composed of a blind bore 2071, an elastic component 2073 settled in the blind bore 2071 and a steel ball 2075 settled in the blind bore 2071 and propped out from the blind bore 2071 by the elastic component 2073. Thereupon, the steel ball 2075 can move vertically with respect to the blind bore 2071 by virtue of an elasticity of the elastic component 2073. By the structure described above, when each said tool arm 203 is pivotally attached to the rotational core 201 by the inner pivot 2033 and moves between the parallel position and the perpendicular position thereof, the steel ball 2075 of the tool arm 203 can move along the guiding slot 205 of the rotational core 201. When the tool arm 203 is pivoted to either the parallel position or the perpendicular position where the steel ball 2075 thereof is aligned to either of the seats 2051 of the guiding slot 205, the steel ball 2075 can be further propped out from the blind hole 2071 for being retained in the aligned seat 2051. As a result, the tool arm 203 can be stably positioned at the parallel position and the perpendicular position thereof with respect to the rotational core 201.

Furthermore, each said tool arm 203 further has an end opposite to that connected to the rotational core 201 pivotally attached by at least one tool element 209. According to the present embodiment, three tool elements 209 are provided for each said tool arm 203 and the tool elements 209 can be, but not limited to, slotted screwdrivers, crosspoint screwdrivers, Allen wrenches and borers with various dimensions. Please refer back to FIG. 2. For pivotally connecting the tool element 209 to the tool arm 203, one outer pivot hole 2035 is provided on the tool arm 203 for an outer pivot 2037 passing therethrough. On the other hand, the tool element 209 has an operational end 2091 formed as the slotted screwdriver, crosspoint screwdriver, Allen wrench, or borer and has one fastening end 2093 opposite to the operational end 2091 thereof formed as a loop-shape so that when the tool element 209 has its fastening end 2093 looping around the outer pivot 2037, it can pivot with respect to the tool arm 203 between a folded position and an extended position. Further, each of the tool arms 203 may be formed with a recess so that the tool elements 209 can be accommodated in the tool arm 203 when they are at the folded position.

According to the present embodiment, each of the tool arms 203 is composed of two outer pieces. Each of the outer pieces and the rotational core 201 jointly sandwich a reinforcement piece and a rib protruding from the outer piece is provided to further combine the outer pieces, the reinforcement pieces and the rotational core 201. Each of the inner pivots 2033 and outer pivots 2037 may be composed of a male member and a female member pierced into the corresponding pivot holes from opposite directions and screwed together.

It is to be noted that by the above-mentioned structures of the tool arms 203 and tool elements 209, each of the operational end 2091 of the tool element 209 is always positioned away from a lengthwise axis of the tool arm 203 at either the folded position or the extended position thereof. According to the present embodiment, when the tool element 209 is at the folded position, it is away from the lengthwise axis of the tool arm 203 and away from an axis of the ratchet assembly 10. Whereas, when the tool element 209 is at the extended position, it is away from the lengthwise axis of the tool arm 203 and adjacent to the axis of the ratchet assembly 10. In other words, when the tool arm 203 is at the parallel position and the tool element is at the extended position, the tool element 209 is parallel and positioned next to the rotation axes of the ratchet assembly 10 and the rotational cores 201.

Following, the descriptions will be directed to the operation of the disclosed versatile folding ratchet tool in accordance with the drawings.

Figure 7:
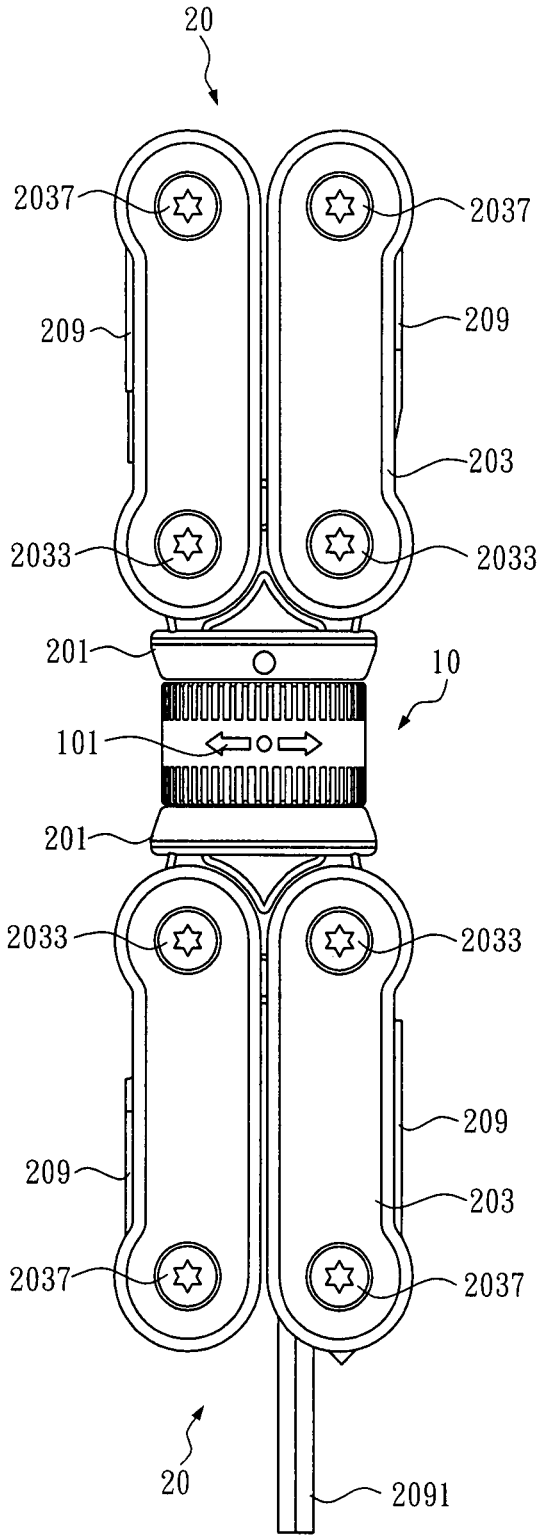
FIG. 7 is an applied view of the versatile folding ratchet tool according to the embodiment of the present invention showing functioning as an I-shaped ratchet hand tool.

When one of the tool arms 203 is at the parallel position with one of the tool elements 209 extended, the two tool arms 203 connected to the other rotational core 201 can jointly act as a handle parallel to the rotation axes of the ratchet assembly 10 and the rotational cores 201. Thereupon, the versatile folding ratchet tool can be operated as an I-shaped ratchet hand tool, as shown in FIG. 7.

Figure 8:
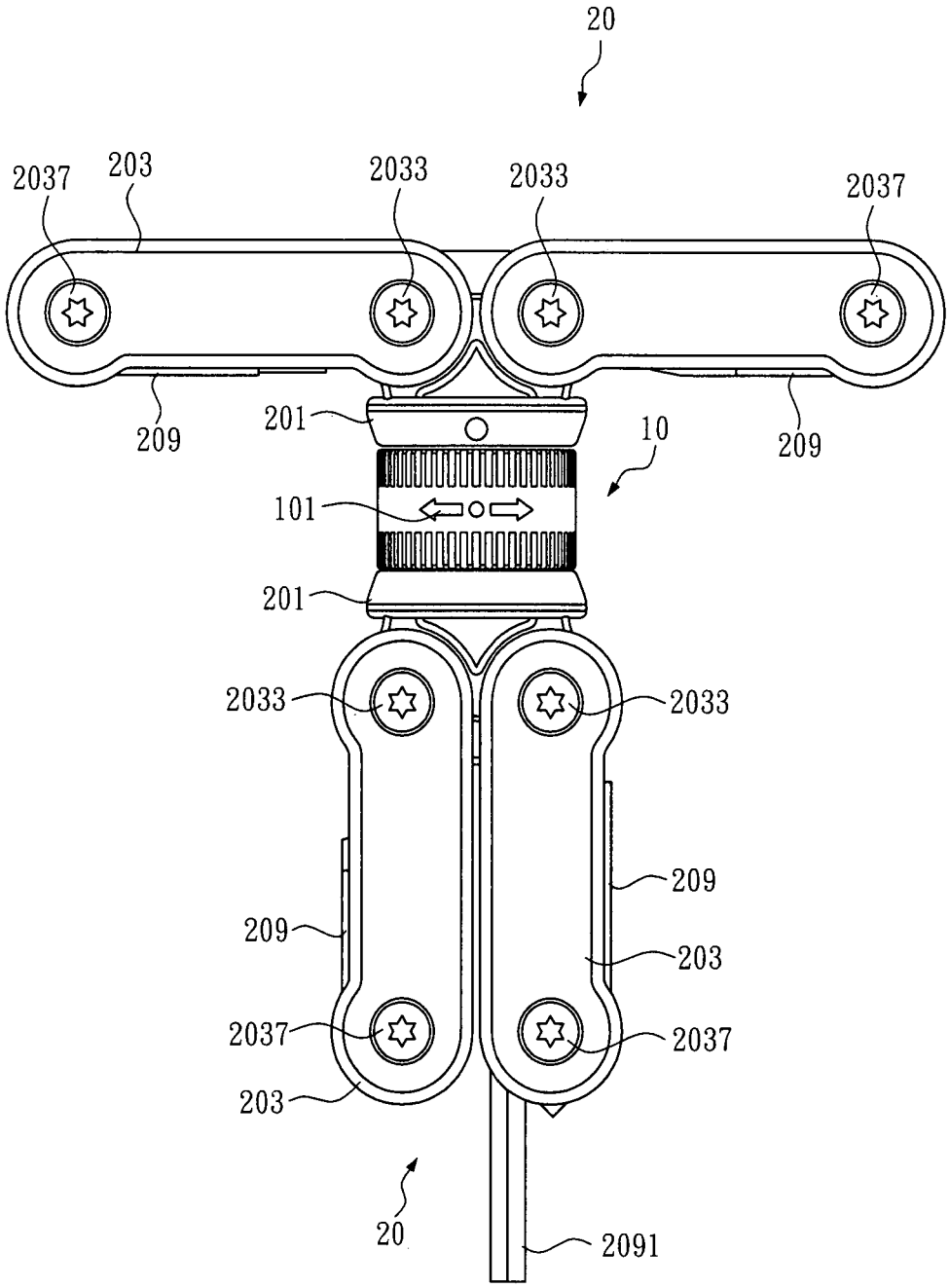
FIG. 8 is another applied view of the versatile folding ratchet tool according to the embodiment of the present invention showing the versatile folding ratchet tool functioning as a T-shaped ratchet hand tool.
Figure 9:
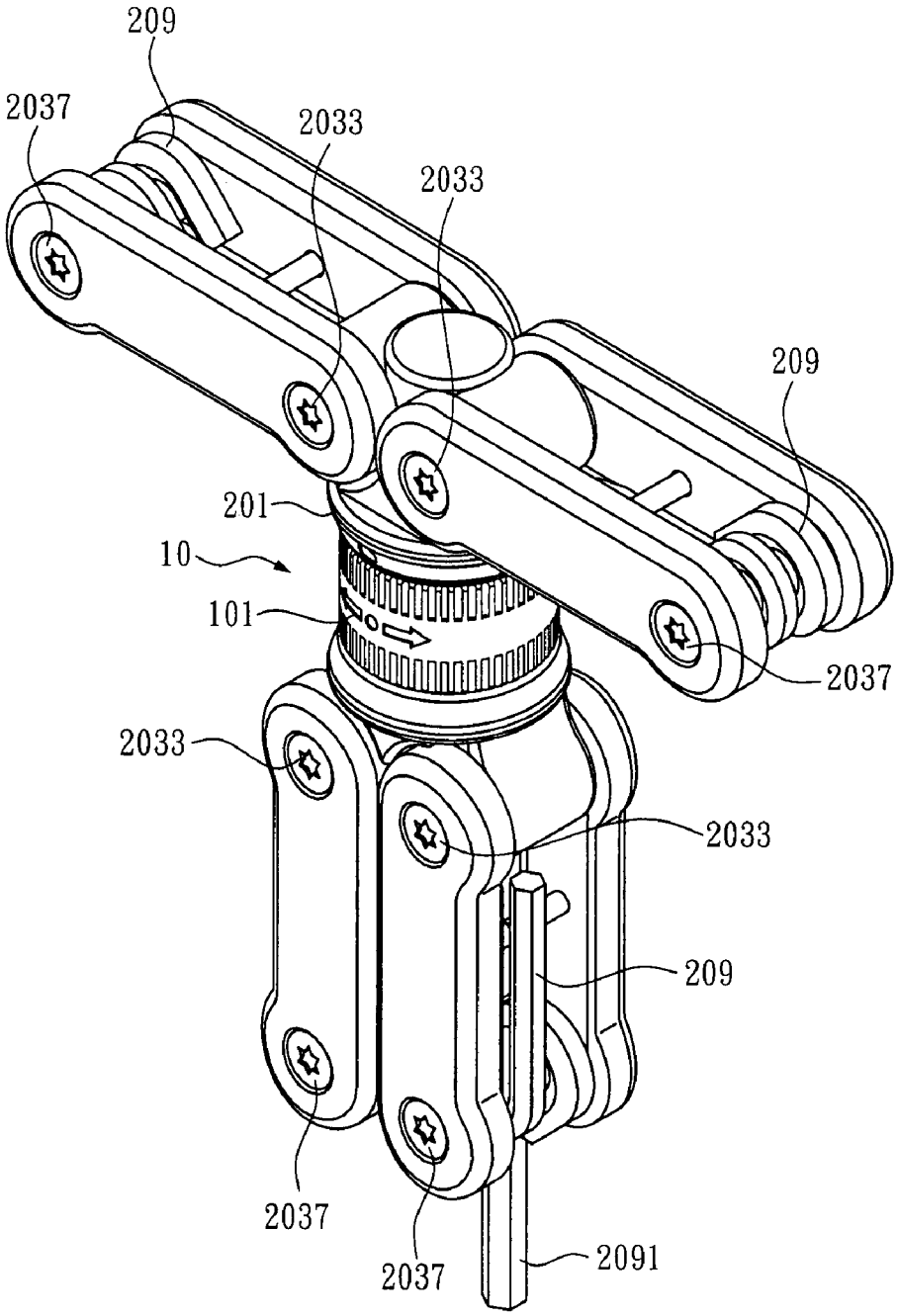
FIG. 9 is a perspective view of a versatile folding ratchet tool of FIG. 8.

When two adjacent tool arms 203 connected to the same rotational core 201 are at the perpendicular positions thereof, a handle perpendicular to the rotation axes of the ratchet assembly 10 and the rotational cores 201 is formed. Then a user can make one said tool element 209 pivot to the extended position where the operational end 2091 thereof is adjacent to the rotation axes of the ratchet assembly 10 and the rotational cores 201. At this time, since the operational end 2091 of the tool element 209 is positioned adjacent to the rotation axes of the ratchet assembly 10 and the rotational cores 201, when the user exerts a screwing force on the handle formed by the two tool arms 203 at the perpendicular positions, the screwing force can act on the operational end with minimum loss. Thus, the versatile folding ratchet tool is now an efficient T-shaped ratchet hand tool, as shown in FIGS. 8 and 9.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A versatile folding ratchet tool comprising:

a ratchet assembly having two driving ends; and two tool assemblies connected to the two driving ends of the ratchet assembly, respectively; wherein each said tool assembly comprises:

a rotational core having one side connected to and driven by the driving end of the ratchet assembly; and two tool arms, each having one end thereof pivotably connected to the rotational core so that the tool arm is able to pivot with respect to the rotational core between a parallel position and a perpendicular position; and having an opposite end thereof pivotally attached by at least one tool element capable of pivoting with respect to the tool arm between a folded position and an extended position wherein a positioning mechanism is provided between the tool arm and the rotational core for positioning the tool arm at either the parallel position or the perpendicular position, wherein the positioning mechanism comprises a guiding slot preformed on the rotational core and a positioning piece mounted on the tool arm in a manner that when the tool arm pivots with respect to the rotational core, the positioning piece moves along the guiding slot.

2. The versatile folding ratchet tool of claim 1 wherein the ratchet assembly is a reversible ratchet assembly.

3. The versatile folding ratchet tool of claim 1 wherein the tool arm is formed with a recess and the tool element recesses in the tool arm when the tool element is at the folded position.

4. The versatile folding ratchet tool of claim 1 wherein the guiding slot on the rotational core is formed with two seats at two end thereof and the positioning piece of the tool arm is elastic in a manner that when the positioning piece moves along the guiding slot and is aligned to one of the seats, the positioning piece can be retained in the seat.

5. The versatile folding ratchet tool of the claim 4, wherein the elastic positioning piece of the tool arm comprises a blind bore, an elastic component settled in the blind bore and a steel ball settled in the blind bore but propped out from the blind bore by the elastic component such that the steel ball can move vertically with respect to the blind bore by virtue of an elasticity of the elastic component.

6. The versatile folding ratchet tool of the claim 1 wherein each of the tool elements is a slotted screwdriver, a crosspoint screwdriver, an Allen wrench or a borer.

7. The versatile folding ratchet tool of claim 1 wherein when the tool arm is at the parallel position and the tool element is at the extended position, the tool element is parallel and positioned next to rotation axes of the ratchet assembly and the rotational cores.

* * * * *